US008522698B2

(12) United States Patent
Lo

(10) Patent No.: US 8,522,698 B2
(45) Date of Patent: Sep. 3, 2013

(54) COMBUSTIBLE ENERGY RECYCLING SYSTEM AND METHOD THEREOF

(75) Inventor: Huan-Ho Lo, Taoyuan County (TW)

(73) Assignee: Hung Chih Corporation Limited (TW)

( * ) Notice: Subject to any disclaimer, the term of this patent is extended or adjusted under 35 U.S.C. 154(b) by 1023 days.

(21) Appl. No.: 12/585,416

(22) Filed: Sep. 15, 2009

(65) Prior Publication Data

US 2011/0061577 A1 Mar. 17, 2011

(30) Foreign Application Priority Data

Jun. 23, 2009 (TW) ..... 98120981 A

(51) Int. Cl.
*F23G 5/24* (2006.01)
*F23G 5/32* (2006.01)

(52) U.S. Cl.
USPC ..... 110/309; 110/297; 110/242; 126/112

(58) Field of Classification Search
USPC ..... 110/204, 205, 206, 211, 213, 214, 110/215, 229, 230, 235, 242, 248, 256, 346, 110/348, 297, 245, 251, 254, 243, 244; 126/99 R, 112, 15 R, 15 A, 77, 146, 163 R
See application file for complete search history.

(56) References Cited

U.S. PATENT DOCUMENTS

| | | | | |
|---|---|---|---|---|
| 4,060,041 | A * | 11/1977 | Sowards | 110/245 |
| 6,886,476 | B2 * | 5/2005 | Katsui | 110/255 |
| 6,987,792 | B2 * | 1/2006 | Do et al. | 110/346 |
| 7,004,087 | B2 * | 2/2006 | Song | 110/235 |
| 7,318,382 | B2 * | 1/2008 | Kaneko | 110/346 |

* cited by examiner

*Primary Examiner* — Kenneth Rinehart
*Assistant Examiner* — David J Laux
(74) *Attorney, Agent, or Firm* — Bacon & Thomas, PLLC

(57) ABSTRACT

In a combustible energy recycling system and its method, the system includes an airtight incinerator body, a gas intake module and a blower. The incinerator body is filled with a combustible waste material, and the gas intake module installed in the incinerator body includes gas intake pipes, and one of the gas intake pipes is an ignition pipe for igniting the waste material in the incinerator body for a smoldering combustion, and an air outlet pipe of the blower is interconnected to the gas intake module for guiding outside air into the incinerator body, such that the outside air can move slowly upward with a high-temperature dense smoke produced in the smoldering combustion and surround every cross-section in the incinerator body for a uniform smoldering combustion, and a gas containing combustible energy in the dense smoke can be guided to a gas recycling mechanism for recycling and reusing the gas.

10 Claims, 5 Drawing Sheets

COMBUSTIBLE ENERGY RECYCLING SYSTEM AND METHOD THEREOF

FIELD OF THE INVENTION

The present invention relates to a recycling system, in particular to a recycling system capable of introducing outside air into the recycling system for a smoldering combustion of a combustible waste material (such as a waste wood, fabric or plastic material) filled into the recycling system, such that the outside air can be distributed around every cross-section in the recycling system and moved together with a high-temperature dense smoke produced in the smoldering combustion to fully incinerate the waste material, and recycle or reuse a gas (such as carbon monoxide and hydrogen gas) containing combustible energy (produced by an incomplete combustion of the waste materials) in the dense smoke to achieve the effects of energy regeneration, recycle and reuse.

BACKGROUND OF THE INVENTION

At present, a waste material (such as a waste wood, fabric or plastic material) that cannot be recycled directly is generally processed by the following two methods:

(1) Landfill Method: Waste materials are buried in soils, such that the waste materials are decomposed by microorganisms in the soils; and (2) Incineration Method: Waste materials are disposed and combusted in an incinerator, such that the waste materials are decomposed into ashes by high-temperature heat and then collected and processed, and the volume of the waste materials can be reduced greatly.

Since the landfill method requires a large landfill site for burying the waste materials, and some countries have small area and dense population and not much land reserved for burying the waste materials continuously. Furthermore, the landfill method creates an odor problem after the waste materials are buried in soils and gradually decayed or decomposed by microorganisms, and a liquid leachate containing microorganisms and germs is produced and permeated into the soil, which contaminates underground water sources and creates crises to our environmental hygiene and ecological condition, or even affects the health of residents nearby. In recent years, governments have started promoting a "zero landfill" policy as the awareness of the environmental protection rises, and adopted the incineration method as a major method for disposing waste materials.

According to related research data, the traditional incinerators presently used for carrying out the incineration method still have the following drawbacks:

(A) In an incineration process of the waste materials taken place in an incinerator, a large amount of dense smoke is produced, and the dense smoke is discharged to the outside directly through a chimney of the incinerator, such that dusts and impurities in the dense smoke are flew and drifted to surrounding areas of the incinerator, and the dusts and impurities spread all over the surrounding areas causes a poor air quality. People living in the surrounding areas inhaling the dusts and impurities for a long time will be harmed by respiratory diseases.

(B) In general, the dense smoke also includes a gas (such as carbon monoxide and hydrogen gas produced by an incomplete combustion of the waste materials) containing combustible energy in addition to the dusts and impurities. However, the incinerator usually does not come with a mechanism for filtering the dusts and impurities and recycling the gas containing the combustible energy, and thus the incinerator not just causes air pollutions only, but also fails to recycle and reuse the gas containing combustible energy or achieve the green environmental protection requirements for energy saving and carbon reduction.

(C) When the incinerator adopts the smoldering combustion method for processing the waste materials instead of combusting the waste materials completely by fire, then the high-temperature dense smoke produced by the smoldering combustion will move upward continuously, and the combustion-supporting air (introduced from the outside) in the incinerator cannot be distributed uniformly to every cross-section of the incineration, such that the waste materials in the incinerator can be combusted successfully at positions next to an ignition point and above the ignition point only, but the waste materials situated at other positions cannot be incinerated completely, and a poor combustion efficiency of the incinerator will result.

Therefore, it is an important subject of the present invention to design an innovative combustible energy recycling system and a method thereof to overcome the shortcomings of the traditional incinerators that cause an air pollution by the combusted waste materials, and enhance the combustion efficiency of the incinerator and recycle and reuse the gas containing combustible energy in the dense smoke when the incinerator adopts the smoldering combustion method for processing the waste materials.

SUMMARY OF THE INVENTION

In view of the shortcomings of the prior art, the inventor of the present invention based on years of experience in the related industry to conduct extensive researches and experiments, and finally developed a combustible energy recycling system and its method to overcome the poor combustion efficiency, air pollution, and difficulty of recycling and reusing a gas (such as carbon monoxide and hydrogen gas produced by an incomplete combustion of waste materials) containing combustible energy in the dense smoke produced by the conventional incinerator.

Therefore, it is a primary objective of the present invention to provide a combustible energy recycling system, comprising an airtight incinerator body and a blower, wherein the incinerator body includes a first gate that can be opened and closed, such that an operator can open the first gate to fill a combustible waste material (such as a waste wood, fabric or plastic material, etc) into the incinerator body, and the blower includes an air outlet pipe, and an end of the air outlet pipe is passed into the incinerator body. The recycling system further comprises a gas intake module installed in the incinerator body and interconnected with the air outlet pipe, and the gas intake module includes a plurality of gas intake pipes, and one of the gas intake pipes is an ignition pipe provided for the operator to ignite the waste materials in the incinerator body through the ignition pipe and allow the waste materials to be smoldered in the incinerator body. The blower introduces outside air into the incinerator body through the gas intake module, and the outside air produces an air whirl flowing with respect to the center of the incinerator inside the incinerator body and surrounding every cross-section inside the incinerator body. The high-temperature dense smoke produced by the smoldering combustion of the waste materials climbs upward, so that the waste materials in the incinerator body can be smoldered uniformly, and the dense smoke produced by the smoldering combustion and the gas containing combustible energy are discharged to a gas recycling mechanism or a burning mechanism for its recycle and reuse. Since the recycling system of the present invention can smolder all waste materials in the incinerator body through the air whirl produced by the outside air to improve the combustion efficiency of the recycling system, and the gas containing combustible energy produced by the smoldering combustion of the waste material in the recycling system can be recycled and reused completely to prevent the dusts and impurities from flying or drifting to the outside, therefore the green environmental protection requirements for energy recycle and reuse, energy saving, and carbon reduction can be met, and the air pollution issue created by the smoldering combustion of the waste materials can be avoided.

Another objective of the present invention is to provide a combustible energy recycling system, wherein the incinerator body includes a water storage tank installed at an internal periphery of the incinerator body and interconnected to a water pipe, for storing liquid coming from the water pipe, and the water storage tank includes at least one ventilation hole formed at a position proximate to the top of the incinerator body, such that when the liquid in the water storage tank is heated and evaporated into steam, the steam can be entered into the interior of the incinerator body through each ventilation hole, and condensed into water drops inside the incinerator body, and the water drops are dropped onto the waste material. As a result, when the interior of the incinerator body has a too-low humidity and a too fiercely burning flame, the water drops dropped on the waste materials can slow down the too-fiercely burning flame and lower the temperature inside the incinerator body when the waste materials are combusted.

Another objective of the present invention is to provide a combustible energy recycling system, wherein the smoke exhaust pipe is installed at a pipe mouth at an end of the incinerator body and towards the bottom of the recycling system, and the recycling system includes a first filter unit in a shape of a tank disposed at a position proximate to an end of the smoke exhaust pipe for containing a liquid, and the level of the liquid is proximate to the pipe mouth of the smoke exhaust pipe, such that when an air pressure produced inside the incinerator body is greater than a predetermined multiple of the outside air pressure, then the dense smoke containing dusts and impurities will be forced to be discharged to the outside through the smoke exhaust pipe. Now, the dusts and impurities having a larger volume and a heavier weight will fall into the liquid, so that the first filter unit can be used for improving the purity of the gas containing combustible energy discharged from the recycling system.

Another objective of the present invention is to provide a method of using the aforementioned recycling system to recycle a gas containing the combustible energy in an incineration of waste materials, so that manufacturers can use the recycling system to increase the combustion efficiency, avoid an air pollution issue caused by a smoldering combustion, and recycle a highly pure gas containing combustible energy effectively to achieve an energy recycling effect.

DETAILED DESCRIPTION OF THE PREFERRED EMBODIMENTS

After a waste material (such as a waste wood, fabric or plastic material) goes through a smoldering combustion, a large amount of carbon dioxide ($CO_2$) and carbon (C) is produced, and water ($H_2O$) contained in the waste material will be heated and evaporated into steam. When the carbon dioxide and carbon produce an endothermic reaction, then carbon monoxide (CO) gas containing combustible energy will be produced. When steam and carbon produce an endothermic reaction, carbon monoxide and hydrogen gas ($H_2$) containing combustible energy will be produced. Thus, the inventor of the present invention based on this principle to design and test repeatedly, and finally developed a combustible energy recycling system and its method in accordance with the present invention to increase the production of gas containing combustible energy when the waste materials are incinerated or smoldered.

Figure 1:
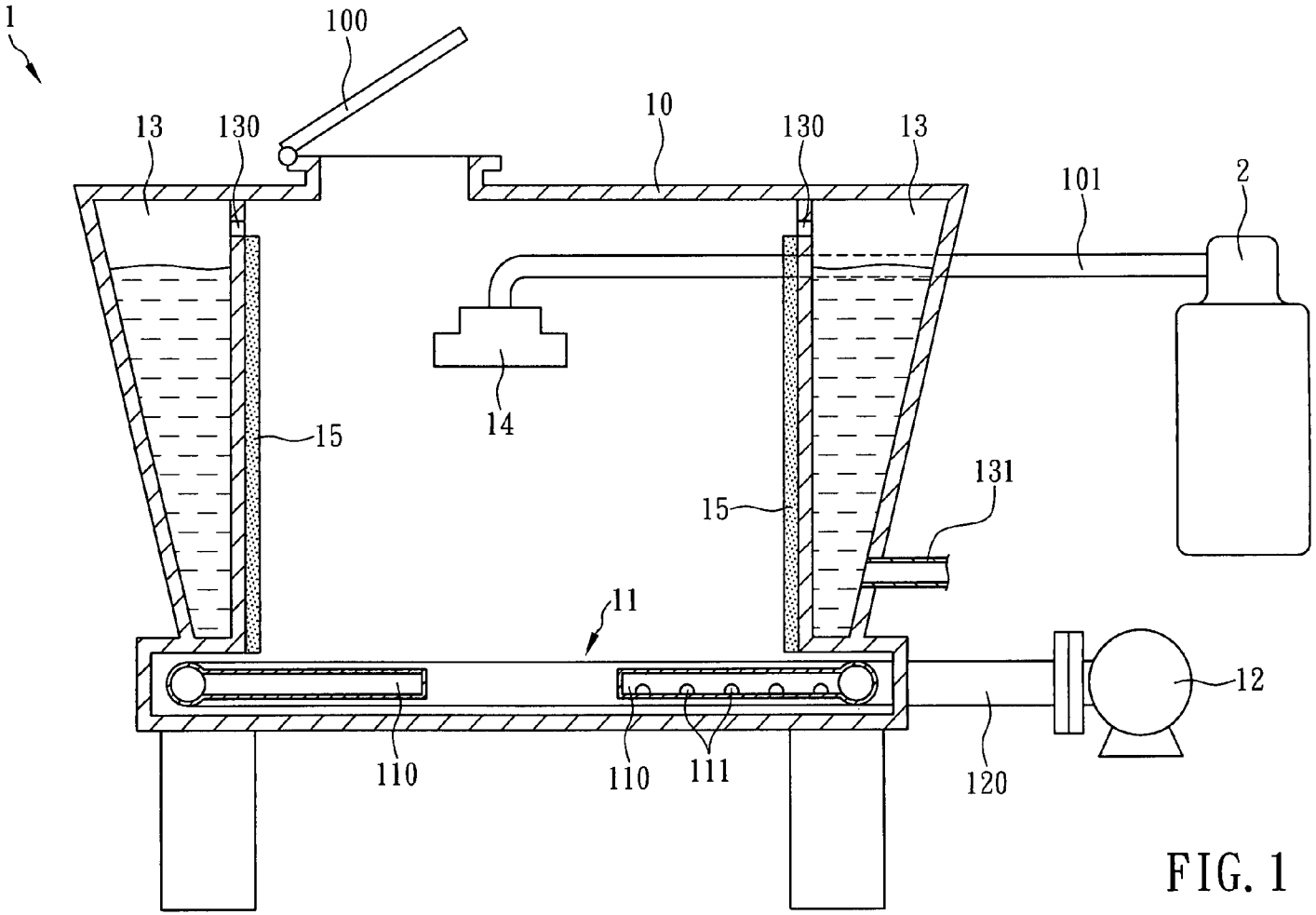
FIG. 1 is a cross-sectional view of a combustible energy recycling system of the present invention.
Figure 2:
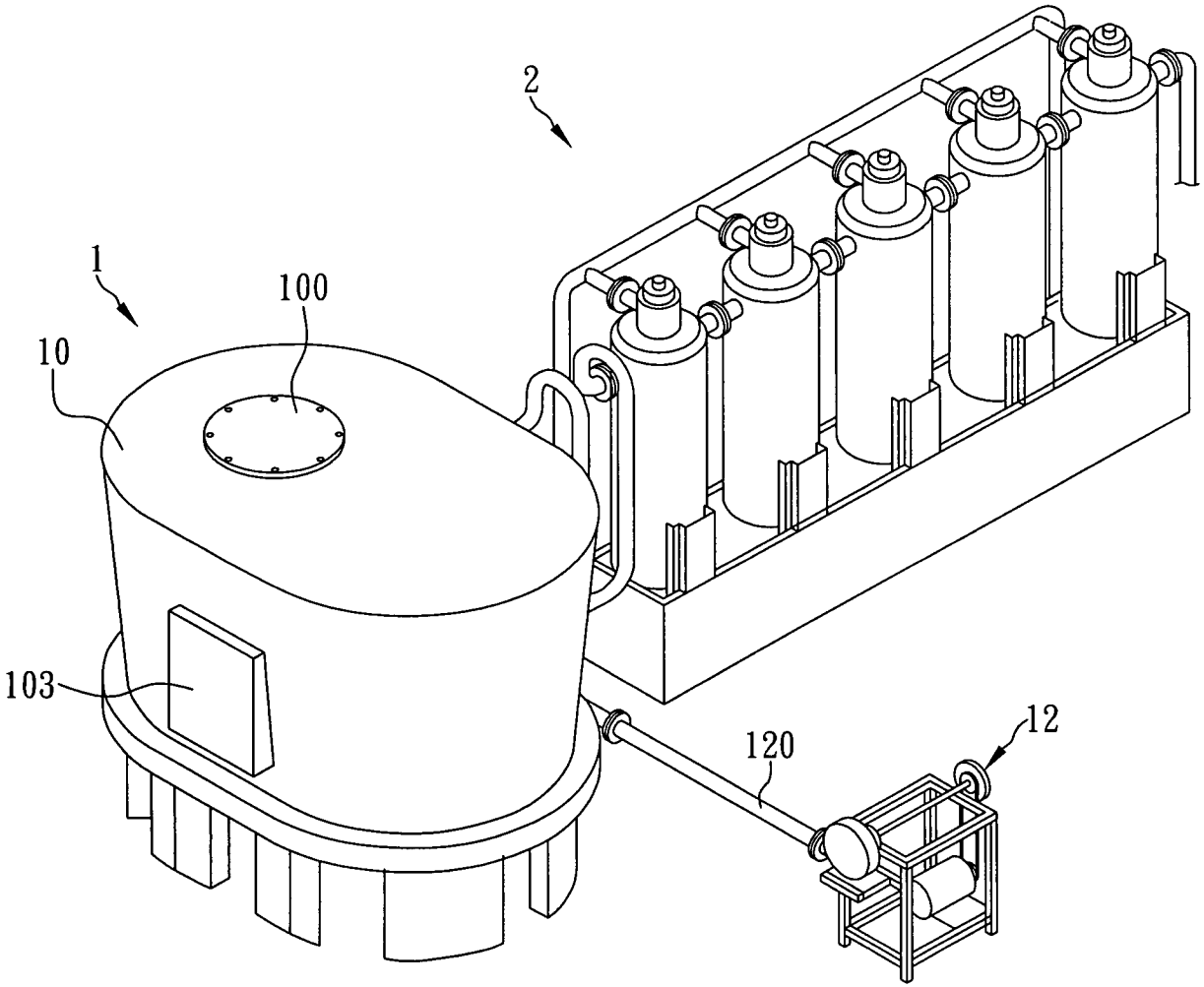
FIG. 2 is a perspective view of a combustible energy recycling system of the present invention.
Figure 3:
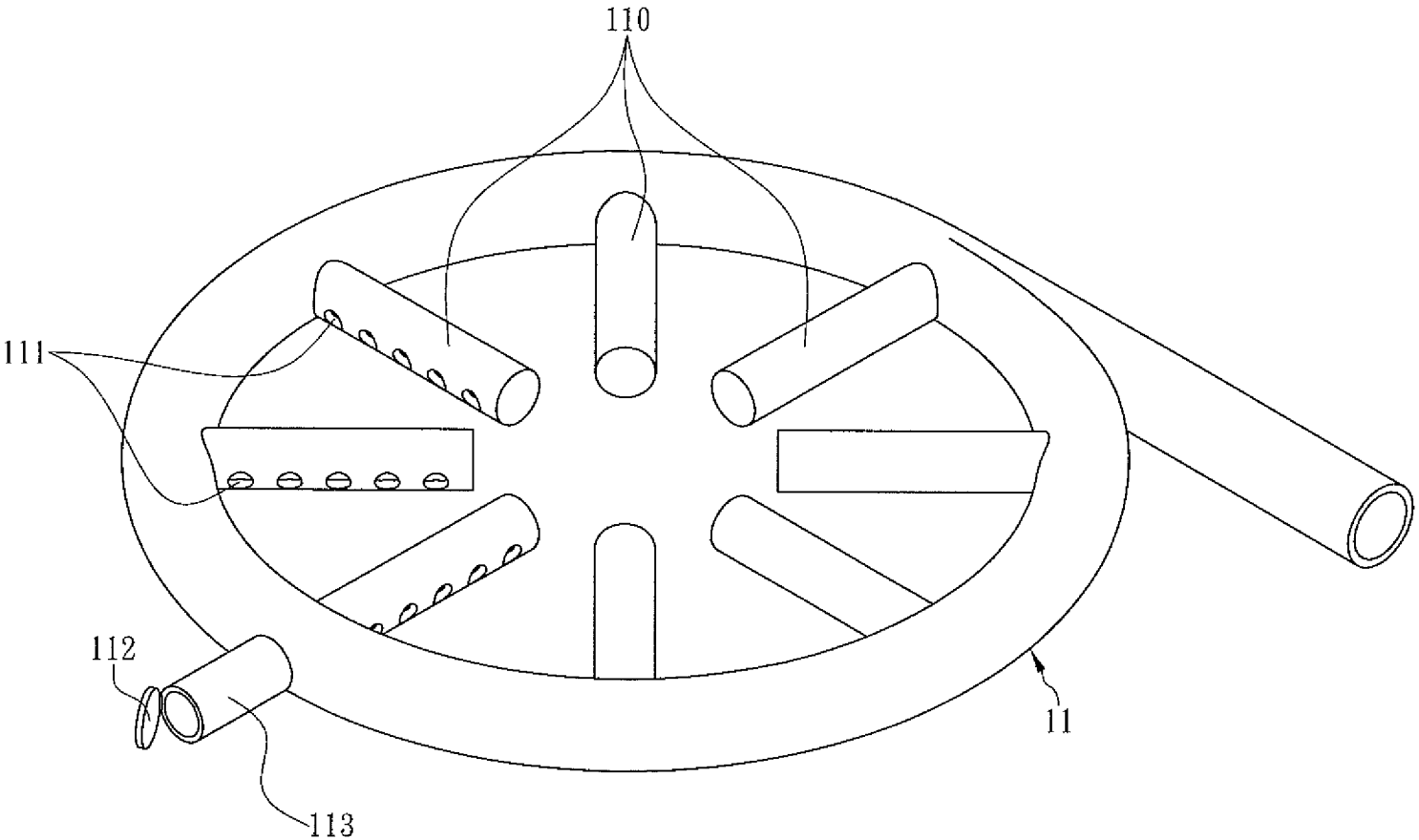
FIG. 3 is a schematic view of an air intake module of a combustible energy recycling system of the present invention.

With reference to FIGS. 1 to 3 for a combustible energy recycling system in accordance with a preferred embodiment of the present invention, the recycling system 1 comprises an airtight incinerator body 10, a gas intake module 11 and a blower 12, wherein the incinerator body 10 includes a first gate 100 that can be opened and closed, and provided for filling a combustible waste material into the incinerator body 10 after an operator opens the first gate 100, and the gas intake module 11 is installed in the incinerator body 10 and disposed at a position proximate to the bottom of the incinerator body 10, and the gas intake module 11 comprises a plurality of gas intake pipes 110 interconnected with one another and extended from the periphery of the incinerator body 10 equidistantly and symmetrically towards the center of the incinerator body 10, and the gas intake pipes 110 includes a plurality of openings 111 equidistantly disposed on a side proximate to the bottom of the incinerator body 10, and one of the gas intake pipes 110 is an ignition pipe 113, and an end of the ignition pipe 113 is extended to a central position of the incinerator body 10, and another end of the ignition pipe 113 is passed out of the incinerator body 10, and the another end of the ignition pipe 113 includes a second gate 112 that can be opened and closed, such that an operator can put a pilot fire at the central position of the incinerator body 10 through the second gate 112 and the ignition pipe 113 to ignite the waste material at the central position of the incinerator body 10, and the waste material starts smoldering in the incinerator body 10, and an air outlet pipe 120 of the blower 12 is passed into the incinerator body 10, and an end of the air outlet pipe 120 is interconnected to the gas intake module 11, such that the blower 12 can guide outside air into the incinerator body 10 through the air outlet pipe 120.

When an operator uses the recycling system 1 for the smoldering combustion of the waste material, outside air is introduced into the incinerator body 10 through the openings 111 of each gas intake pipe 110. An air whirl is formed uniformly at the bottom position of the incinerator body 10 and flows in circumferential directions of different radii with respect to the center of the incinerator, and the blower 12 produces an air pressure inside the incinerator body 10 which is greater than a predetermined multiple of the outside air pressure, such that the outside air can rise slowly upward together with a high-temperature dense smoke produced in the smoldering combustion of the waste material and uniformly surround every cross-section in the incinerator body 10, and the waste material at every cross-section of the incinerator body 10 can be smoldered evenly from the bottom to the top at a predetermined air pressure, as well as the appropriate combustion temperature and humidity in the incinerator body 10. Therefore, the dense smoke and a gas such as carbon monoxide and hydrogen gas containing combustible energy (produced by an incomplete combustion of the waste materials) can be guided from a smoke exhaust pipe 101 of the incinerator body 10 to a gas recycling mechanism 2 or a burning mechanism 2 for recycling or reusing the gas containing the combustible energy.

Since the recycling system 1 of the present invention can introduce outside air uniformly through the blower 12 and the gas intake module 11 for an uniform smoldering combustion of the waste material in every cross-section of the incinerator body 10 to fully smolder all waste materials in the incinerator body 10, so as to achieve the effect of improving the combustion efficiency of the recycling system 1. While the waste material is being incinerated, the recycling system 1 can recycle or reuse the gas containing combustible energy produced in the smoldering combustion, and thus the invention can avoid the air pollution issue created by the flying or drifting of dusts and impurities in the dense smoke to the outside, so as to achieve the effects of energy recycle and reuse and meet the green environmental protection requirements for energy saving and carbon reduction.

In the preferred embodiment as shown in FIG. 1, the incinerator body 10 further comprises a water storage tank 13 installed on an internal periphery of the incinerator body 10 and interconnected to a water pipe 131 for storing a liquid coming from the water pipe 131, such that when the recycling system 1 carries out the smoldering combustion of the waste material and the temperature inside the incinerator body 10 rises, the water storage tank 13 is provided for preventing heat energy from conducting directly to an external surface of the incinerator body 10 and preventing an operator from being burned by accidentally touching the external surface of the incinerator body 10. In addition, the water storage tank 13 includes at least one ventilation hole 130 formed at a position proximate to the top of the incinerator body 10. When the liquid in the water storage tank 13 is heated and evaporated into steam, the steam can be entered into the incinerator body 10 through each ventilation hole 130 and condensed into water drops at the top inside the incinerator body 10, and the water drops can be dropped onto the waste material to retard a too fiercely burning flame of the waste material when the interior of the incinerator body 10 has a too-low humidity, and lower the combustion temperature of the interior of the incinerator body 10, and maintain the temperature and humidity of the waste materials in the incinerator body 10 at predetermined ideal values to enhance the production of gas containing combustible energy and the using safety of the recycling system 1.

Figure 4:
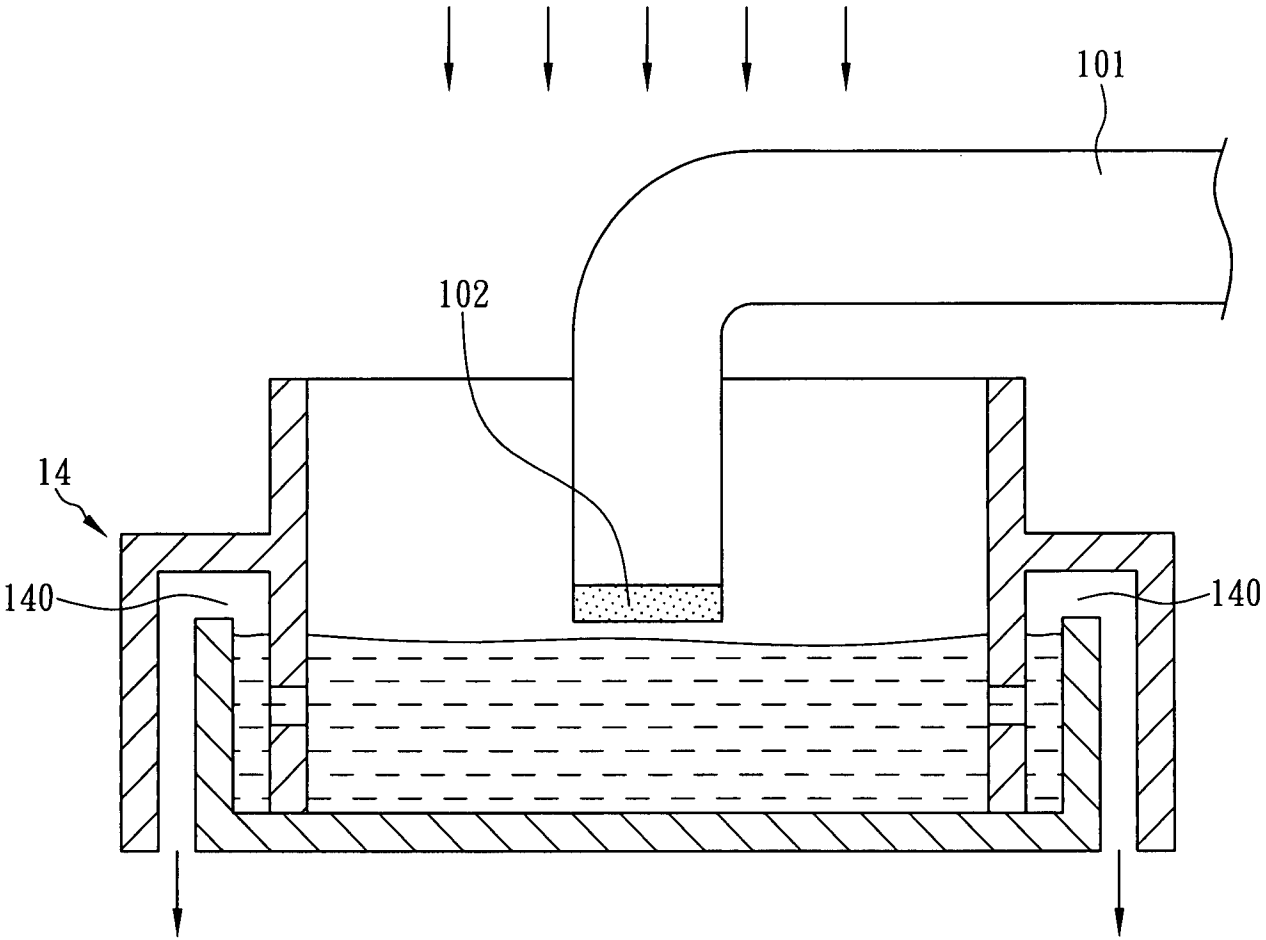
FIG. 4 is a schematic view of a first filter unit of a combustible energy recycling system of the present invention.

In the preferred embodiment as shown in FIGS. 1 and 4, the smoke exhaust pipe 101 has a bent position situated at the top inside the incinerator body 10 for aligning a pipe mouth of the smoke exhaust pipe 101 towards the bottom of the recycling system 1, and the recycling system 1 further comprises a first filter unit 14 in form of a tank disposed at a position proximate to the pipe mouth of the smoke exhaust pipe 101, and the first filter unit 14 is capable of containing liquids, and the level of the liquid is adjacent to the pipe mouth of the smoke exhaust pipe 101, wherein the first filter unit 14 has an opening with a diameter greater than the diameter of the pipe mouth of the smoke exhaust pipe 101 for receiving water drops formed by the condensing the steam at the top of the incinerator body 10. When the interior of the incinerator body 10 has an air pressure greater than a predetermined multiple of the outside air pressure, the dense smoke containing the dusts and impurities is forced to be discharged to the outside through the smoke exhaust pipe 10. Since the smoke containing the dusts and impurities will pass through a gap formed between the pipe mouth of the smoke exhaust pipe 101 and the position of the level of the liquid, the dusts and impurities having a larger volume and a greater weight can be attached to the moisture and fallen into the liquid more easily due to the heavier weight, so as to improve the purity of the gas containing combustible energy discharged from the recycling system 1 and prevent the dusts and impurities from sticking onto the inner wall of the smoke exhaust pipe 101 to avoid clogging the smoke exhaust pipe 101.

In the preferred embodiment as shown in FIGS. 1 and 4, the first filter unit 14 comprises at least one overflow vent 140 formed at a horizontal position proximate to the pipe mouth of the smoke exhaust pipe 101, such that when the liquid level exceeds the height of each overflow vent 140, the liquid with a level higher than each overflow vent 140 will be discharged to the outside of the first filter unit 14. When the steam is condensed into water drops at the top of the incinerator body 10 and fallen into the first filter unit 14 continuously, and the liquid inside the first filter unit 14 has a level higher than each overflow vent 140, the liquid will be discharged to the outside through each overflow vent 140 and dropped onto the waste material under the first filter unit 14 to retard the too-fiercely burning flame of the waste material and lower the combustion temperature inside the incinerator body 10 to maintain the temperature and humidity of the waste material in the incinerator body 10 at predetermined ideal values, so as to improve the production of gas containing combustible energy and the using safety of the recycling system 1.

In the preferred embodiment as shown in FIG. 1, the incinerator body 10 includes at least one insulating layer 15 disposed on an internal wall of the incinerator body 10, such that when the recycling system 1 carries out the smoldering combustion of the waste materials, and the temperature of the incinerator body 10 rises, each insulating layer 15 is provided for preventing heat energy from conducting directly to the external surface of the incinerator body 10 and preventing an operator from being burned by accidentally touching the external surface of the incinerator body 10, and enhancing the using safety of the recycling system 1 effectively.

In the preferred embodiment as shown in FIGS. 1 and 4, the smoke exhaust pipe 101 includes a second filter unit 102 disposed at a pipe mouth proximate to another end of the smoke exhaust pipe 101, such that when the dense smoke containing dusts and impurities enters from the incinerator body 10 into the smoke exhaust pipe 101, the second filter unit 102 can further filter the dusts and impurities having a larger size to prevent the dusts and impurities from being adhered onto pipe walls of the smoke exhaust pipe 101 or clogging the smoke exhaust pipe 101. The second filter unit 102 is provided for assuring a smooth flow of the gas in the smoke exhaust pipe 101 to improve the exhaustion efficiency, such that the recycling system 1 can discharge the gas containing combustible energy more efficiently for the recycle and reuse by the gas recycling mechanism 2 or burning mechanism 2.

In the preferred embodiment as shown in FIG. 2, the incinerator body 10 further comprises a third gate 103 installed on a side of the incinerator body 10 and the third gate 103 can be opened and closed, such that when the waste material is incinerated by the recycling system 1 continuously and ashes are produced by the incineration of the waste material and accumulated in the incinerator body 10, an operator can open the third gate 103 to remove the ashes remained after the smoldering combustion of the waste material.

Figure 5:
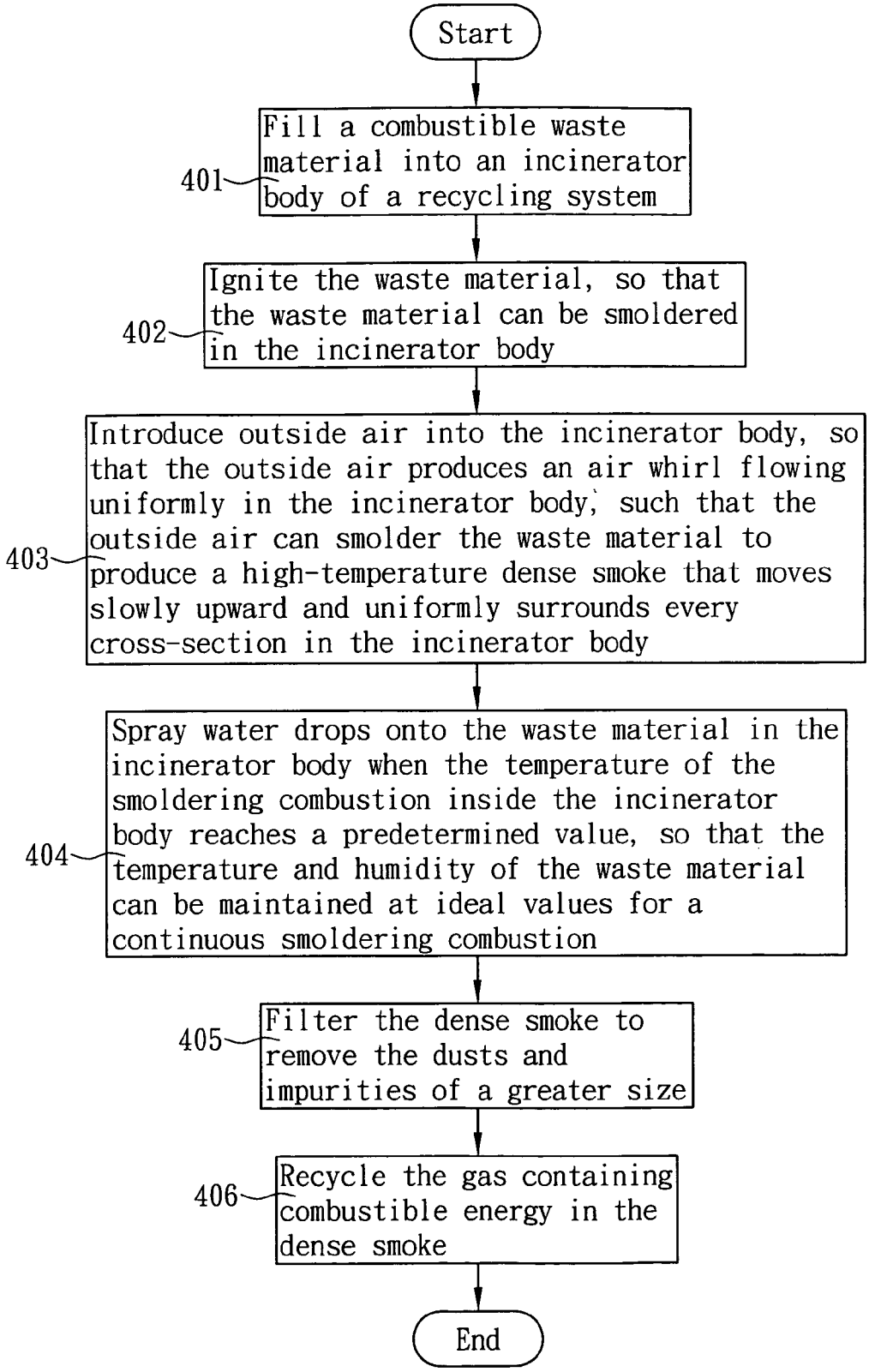
FIG. 5 is a flow chart of a combustible energy recycling method of the present invention.

In the preferred embodiment as shown in FIGS. 1 and 5, a combustible energy recycling method is applied to the recycling system 1 of the present invention comprises the steps of:

(401) filling a combustible waste material into an airtight incinerator body 10 of the recycling system 1;

(402) igniting the waste material, so that the waste material can be smoldered in the incinerator body 10;

(403) introducing outside air into the incinerator body 10 through a gas intake module 11 and a blower 12, so that the outside air produces an air whirl flowing with respect to the center of the incinerator inside the incinerator body and in circumferential directions of different radii and surrounding every cross-section inside the incinerator body, such that the interior of the incinerator body 10 has an air pressure greater than a predetermined multiple of the outside air pressure, and the outside air moves upward slowly together with the high-temperature dense smoke produced in the smoldering combustion of the waste material, and uniformly surrounds every cross-section in the incinerator body 10;

(404) spraying water drops onto the waste material smoldered in the incinerator body 10, when the temperature of the smoldering combustion inside the incinerator body 10 reaches a predetermined value and water drops are condensed in the incinerator body 10 and stored in the aforementioned water storage tank 13, or the liquid overflowed from the overflow vent 140 (as shown in FIG. 4) of the first filter unit 14 to retard the too-fiercely burning flame of the waste material and lower the combustion temperature inside the incinerator body 10, such that the temperature and humidity of the waste material can be maintained at ideal values for a continuous smoldering combustion;

(405) using each filter unit 14, 102 (as shown in FIG. 4) to filter the dense smoke and remove the dusts and impurities of a greater size; and (406) recycling or reusing the gas containing combustible energy in the dense smoke by a gas recycling mechanism 2 or a burning mechanism 2.

With this method, all waste materials in the incinerator body 10 of the recycling system 1 can be incinerated completely by the smoldering combustion to improve the combustion efficiency of the recycling system 1. While the recycling system 1 incinerates the waste material, the gas containing combustible energy produced by the smoldering combustion is recycled and the dusts and impurities are prevented from flying to the outside, so as to achieve the recycling and reuse effects, meet the green environmental protection requirements for energy saving and carbon reduction, and prevent an air pollution issue caused by the smoldering combustion.

In summation of the description above, the present invention overcomes the low combustion efficiency, air pollution, and difficulty of recycling the gas containing combustible energy in the dense smoke of a conventional incinerator effectively, and further achieves the effect of reducing contaminations and meets the green environmental protection requirements for energy saving and carbon reduction. In addition, the recycling system 1 further prevents an operator from being burned by accidentally touching the external surface of the incinerator body 10, and thus the invention provides a better safety for operators.

While the invention has been described by means of specific embodiments, numerous modifications and variations could be made thereto by those skilled in the art without departing from the scope and spirit of the invention set forth in the claims.

What is claimed is:

1. A combustible energy recycling system, comprising:

an airtight incinerator body, including a first gate that can be opened and closed, and provided for filling a combustible waste material into the incinerator body when the first gate is opened, and a smoke exhaust pipe installed at a position proximate to the top of the incinerator body;

a gas intake module, installed in the incinerator body and at a position proximate to the bottom of the incinerator body, and including a plurality of gas intake pipes interconnected with one another, and extended equidistantly and symmetrically from a periphery of the incinerator body in a direction towards the center of the incinerator body, and a plurality of openings equidistantly disposed on a side of each of the gas intake pipe and in a direction proximate to the bottom of the incinerator body for introducing outside air into the incinerator body and forming an air whirl at the bottom of the incinerator body and flows with respect to the center of the incinerator body and in circumferential directions of different radii, and one of the gas intake pipes being an ignition pipe, and an end of the ignition pipe being extended from a central position of the incinerator body, and another end of the ignition pipe passing out of the incinerator body, and the another end of the ignition pipe including a second gate that can be opened and closed and provided for igniting a waste material in the incinerator body when the second gate is opened, and performing a smoldering combustion of the waste material in the incinerator body when the waste material is ignited and the first and second gates are closed; and a blower, including an air outlet pipe installed thereon and passed into the incinerator body, and an end of the air outlet pipe being interconnected to the gas intake module, such that when the blower is operated, the blower will be able to introduce outside air into the incinerator body through the air outlet pipe, such that the outside air produces the air whirl flowing uniformly with respect to the center of the incineration, and from the bottom of the incinerator body through the openings and in circumferential directions of different radii, and the blower produces an air pressure inside the incinerator body which is greater than a predetermined multiple of an outside air pressure, so that the outside air can move upward slowly together with a high-temperature dense smoke produced by the smoldering combustion of the waste material and surround every cross-section in the incinerator body uniformly, and the waste material at every cross-section in the incinerator body can be smoldered uniformly at a predetermined air pressure as well as appropriate combustion temperature and humidity in the incinerator body, and the dense smoke with the gas containing combustible energy can be guided out of the smoke exhaust pipe.

2. The combustible energy recycling system of claim 1, wherein the incinerator body further includes a water storage tank installed on an internal periphery of the incinerator body and interconnected to a water pipe for storing a liquid coming from the water pipe, and the water storage tank includes at least one ventilation hole formed at a position proximate to the top of the incinerator body, such that when the liquid in the water storage tank is heated and evaporated into steam, the steam is entered into the incinerator body through each ventilation hole.

3. The combustible energy recycling system of claim 2, wherein the smoke exhaust pipe has a pipe mouth installed at a top end inside the incinerator body and towards the bottom of the recycling system, and the recycling system further comprises a first filter unit in a form of a tank installed at a position proximate to the pipe mouth of the smoke exhaust pipe for containing a liquid, and a level of the liquid is situated adjacent to the pipe mouth of the smoke exhaust pipe, and the first filter unit has an opening with a diameter greater than the diameter of the pipe mouth of the smoke exhaust pipe, for receiving water drops formed by condensing the steam at the top of the incinerator body.

4. The combustible energy recycling system of claim 3, wherein the first filter unit includes at least one overflow vent disposed on a horizontal position proximate to the pipe mouth of the smoke exhaust pipe, such that when the liquid level is higher than each overflow vent, the liquid higher than each overflow vent will be discharged.

5. The combustible energy recycling system of claim 3, wherein the incinerator body further comprises at least one insulating layer installed at the inner wall thereof for reducing heat energy from conducting to an external surface of the incinerator body due to the smoldering combustion, when the waste material is smoldered.

6. The combustible energy recycling system of claim 4, wherein the incinerator body further comprises at least one insulating layer installed at the inner wall thereof for reducing heat energy from conducting to an external surface of the incinerator body due to the smoldering combustion, when the waste material is smoldered.

7. The combustible energy recycling system of claim 5, wherein the smoke exhaust pipe includes a second filter unit installed into the pipe mouth proximate to an end of the smoke exhaust pipe for filtering dusts and impurities in the dense smoke.

8. The combustible energy recycling system of claim 6, wherein the smoke exhaust pipe includes a second filter unit installed into the pipe mouth proximate to an end of the smoke exhaust pipe for filtering dusts and impurities in the dense smoke.

9. The combustible energy recycling system of claim 7, wherein the incinerator body further includes a third gate that can be opened and closed, and disposed on a side of the incinerator body, for removing ashes remained from the smoldering combustion of the waste material when the third gate is opened.

10. The combustible energy recycling system of claim 8, wherein the incinerator body further includes a third gate that can be opened and closed, and disposed on a side of the incinerator body, for removing ashes remained from the smoldering combustion of the waste material when the third gate is opened.

* * * * *